United States Patent [19]

Narayan

[11] 4,092,767

[45] June 6, 1978

[54] LAMINATED BUCKLE WITH NO FALSE LATCH

[75] Inventor: Surendra D. Narayan, Warren, Mich.

[73] Assignee: Allied Chemical Corporation, Morris Township, N.J.

[21] Appl. No.: 662,990

[22] Filed: Mar. 1, 1976

[51] Int. Cl.[2] ..... A44B 11/26

[52] U.S. Cl. ..... 24/230 AL

[58] Field of Search ..... 24/230 AL, 230 A, 230 AN

[56] References Cited

U.S. PATENT DOCUMENTS

| | | | |
|---|---|---|---|
| 3,579,750 | 5/1971 | Wagner | 24/230 A |
| 3,807,000 | 4/1974 | Weman | 24/230 AL |
| 3,911,236 | 10/1975 | Poulsen | 24/230 AL |
| 3,919,508 | 11/1975 | Levasseur | 24/230 AL |
| 3,969,795 | 7/1976 | Stephenson | 24/230 AL |

FOREIGN PATENT DOCUMENTS

| | | | |
|---|---|---|---|
| 2,263,955 | 7/1974 | Germany | 24/230 A |
| 962,835 | 7/1964 | United Kingdom | 24/230 A |
| 1,123,686 | 8/1968 | United Kingdom | 24/230 A |

*Primary Examiner*—Bernard A. Gelak
*Attorney, Agent, or Firm*—Roger H. Criss

[57] ABSTRACT

The buckle includes: at least three laminate plates, a movable latch means, a manually operable actuation means, and a no false latch biasing means. The biasing means includes: a tongue engaging portion which may be at least one upper arm, an energy storage means which may be at least one coil torsion spring, and a latch engaging portion which may be at least one lower arm. The biasing means moves the latch means into engagement with the tongue when the tongue is substantially inserted in the buckle and ejects the tongue upon movement of the latch means by the actuation means. The buckle offers low resistance to insertion of the tongue until the tongue nears its fully inserted position and thereby avoids a problem of "false latching".

8 Claims, 3 Drawing Figures

LAMINATED BUCKLE WITH NO FALSE LATCH

BACKGROUND OF THE INVENTION

The present invention relates to a buckle, such as a safety belt buckle for restraining occupants in a vehicle, such as an automobile. More particularly, the present invention relates to improvements in a buckle made of laminate plates. The improvements include a no false latch spring which prevents a problem of "false latching".

A resistance is felt when a user inserts a tongue into a buckle. The resistance gradually increases until a latching member snaps into engagement with the tongue. It is possible that a user of the buckle could misinterpret the force of insertion and believe that he has latched the tongue into the buckle when the tongue is only partially inserted and has not been latched in the buckle. Such a possibility is referred to as the problem of "false latching". A no false latch mechanism of a different design for a non-laminate buckle is disclosed in U.S. Pat. No. 3,807,000 to P. O. Weman entitled "Belt Buckle with Double Acting Unitary Spring". Buckles made of a plurality of laminate plates are disclosed in U.S. Pat. Nos. 3,911,236 to A. E. Poulsen entitled "Laminated Buckle Housing"; 3,919,508 to D. Levasseur entitled "Buckle Housing"; and U.S. patent application Ser. No. 506,070 filed in the name of R. L. Stephenson, entitled "Safety Belt Buckle".

SUMMARY OF THE INVENTION

The present invention is a buckle which includes: at least three laminate plates secured together, a movable latch means, a manually operable actuation means, and a biasing means. The laminate plates include a first plate, a second plate, and a third plate. The second plate is disposed between the first plate and the third plate. Each of the plates have a cavity in the central portion thereof. The cavities are in substantial alignment with one another. The second plate includes guide means extending from an exterior forward end of the second plate to its cavity for guiding a tongue into the buckle. The latching means engages the tongue. A portion of the latching means extends in and is movable within the cavity of at least the third plate. A portion of the actuating means extends in and is movable in the cavity of at least the first plate.

The biasing means moves the latching means into engagement with the tongue when the tongue is substantially fully inserted into the buckle and ejects the tongue upon movement of the latching means by the actuation means. The buckle offers low resistance to insertion of the tongue until the tongue nears its fully inserted position in the buckle. The biasing means has a tongue engaging portion, and energy storage portion, and a latch engaging portion. During insertion of the tongue in the buckle, the tongue engaging portion, upon movement by the tongue, causes storage of energy in the energy storage portion. The energy storage portion, upon storage of a sufficient amount of energy, moves the latching means to engage the tongue into the buckle. For removal of the tongue from the buckle, movement of the latch engaging portion by the latching means causes storage of energy in the energy storage portion. When the latching means is disengaged from the buckle, the tongue engaging portion ejects the tongue.

DETAILED DESCRIPTION

Figure 1:
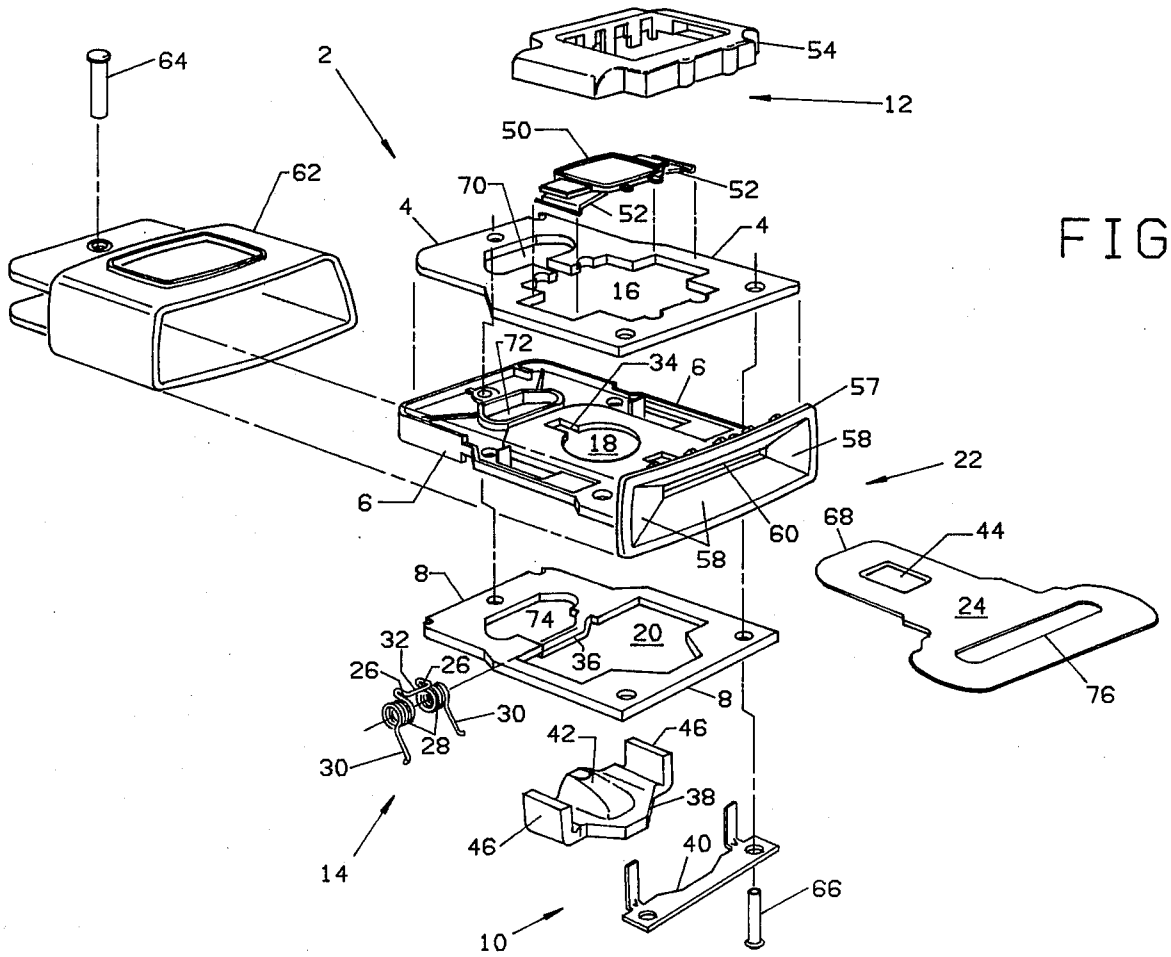
FIG. 1 is an exploded perspective view of the buckle of the present invention.
Figure 3:
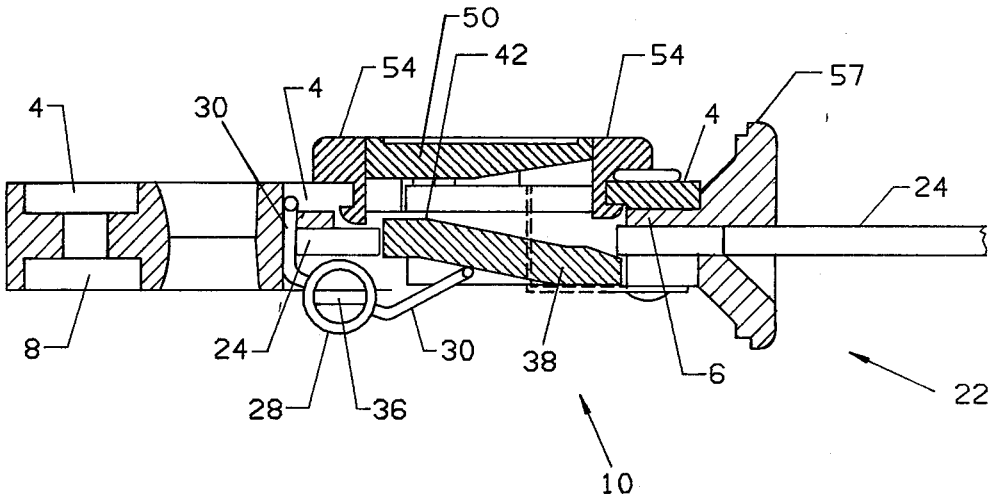
FIG. 3 is a cross-sectional view of the buckle of FIG. 1 when the tongue is fully inserted in the buckle.
Figure 2:
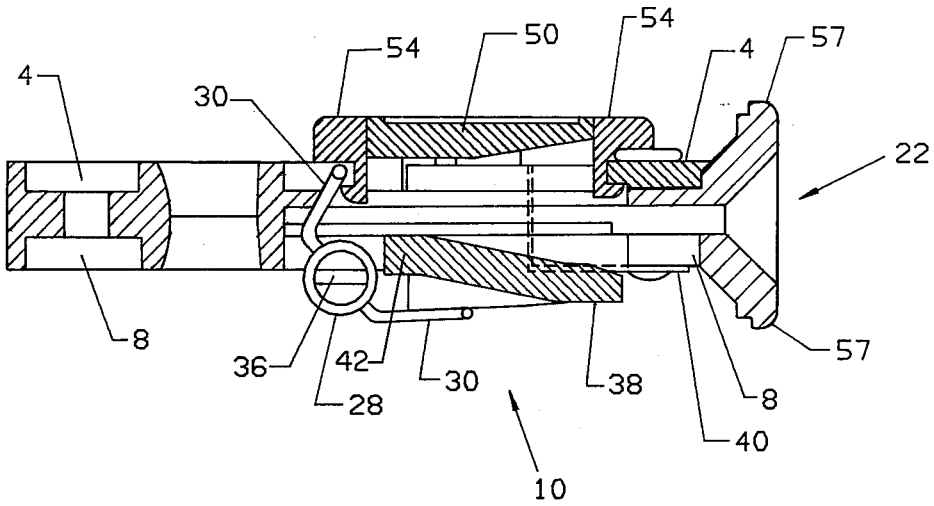
FIG. 2 is a cross-sectional view of the buckle of FIG. 1 when the tongue is not inserted in the buckle.

Referring to FIGS. 1–3, the buckle of the present invention referred to generally by the numeral 2, may be used in a wide variety of applications, such as in a safety belt system in a vehicle, such as an automobile. The buckle 2 includes: at least three laminate plates, that is, a first or upper plate 4, a second or middle plate 6, and a third or bottom plate 8. The buckle 2 also includes: a movable latch means, referred to generally by the numeral 10, a manually operable actuation means, referred to generally by the numeral 12, and a no false latch biasing means, referred to generally by the numeral 14.

The second plate 6 is disposed between the first plate 4 and the third plate 8. Each of the plates 4, 6 and 8 have a cavity (14, 16 and 18 respectively) in the central portion thereof. The cavities 14, 16 and 18 are in substantial alignment with one another. The second plate 6 includes guide means, referred to generally by the numeral 22, extending from an exterior forward end of the second plate 6 to its cavity 18 for guiding a tongue 24 into the buckle 2.

The latching means 10 engages the tongue 24 when the tongue 24 is inserted in the buckle 2. Referring to FIGS. 2 and 3, a portion of the latching means 10 extends in and is movable within at least the cavity 20 of the third plate 20. A portion of the actuation means 12 extends in and is movable in at least the cavity 16 of the first plate 4.

Referring to FIGS. 1–3, the biasing means 14 is disposed in the buckle 2 near a fully inserted position of the tongue 24 in the buckle 2. The biasing means 14 has a tongue engaging portion, such as at least one upper arm 26. The biasing means 14 also includes an energy storage means, such as at least one coil torsion spring 28. The biasing means also includes a latch engaging portion, such as at least one lower arm 30. The lower arm 30 is arranged at an angle of less than 90° with reference to the upper arm 26. Preferably, the angle is between 30° and 60°, more preferably, about 45°.

Preferably, the tongue engaging portion consists of two upper arms 26, joined together at their ends remote from the spring 28 by a cross member 32, forming an approximate "U" shape. Preferably, the energy storage portion consists of two coil springs 28, each spring 28 integral with one of the upper arms. The springs 28 are arranged along a common longitudinal axis, separated by a distance which corresponds approximately to the length of the cross member 32 joining the upper arms. Preferably, the latch engaging portion consists of two lower arms 30. One lower arm 30 projects from each remote end of the springs 28.

The upper arms 26 extend through a slot 34 which projects rearwardly from the cavity 18 of the second plate 6. The torsion springs 28 are mounted on a step member 36 of the third plate 8. The lower arms 30 extend under the latch member 11.

The latch means 10 includes: a latch bar 38 and a guide 40 for the latch bar. The latch bar 38 has a raised portion 42 in the center thereof adapted to mate with an opening 44 in the tongue 24. The latch bar 38 has upturned flanges 46 at each end which extend into the cavities 20 and 18 of the third plate 8 and the second plate 6. Preferably, the flanges 46 also extend in the cavity 16 of the first plate 4 when the latch bar 38 is moved upwardly to engage the tongue 24.

The actuation means 12 includes: a push button 50, a biasing means, such a leaf spring 52, for the push button 50, and a crush ring 54 which guides the push button 50.

The guide means 22 includes: a V shaped lip 57 at the forward end of the second plate 6 adjacent to where the tongue 24 enters the buckle 2. The lip 57 has opposing side walls 58 which converge into an opening 60. The guide means 56 also includes spaced apart parallel walls on the under side of the second plate 6.

A cover 62 is provided to enclose the three laminate plates 4, 6 and 8; latch means 10; actuation means 12; and biasing means 14. A rivet 64, screw or other fastening means extends through a rear end of the cover 62 and a rear end of the laminate plates 4, 6 and 8, remote from where the tongue 24 enters the buckle 2, to secure these parts together. At least one, and preferably two rivets 66, screws or other fastening means extend through the forward end of the three laminate plates 4, 6 and 8, adjacent to where the tongue 24 enters the buckle 2, to secure them together.

The number of laminate plates employed may vary depending on the depth of the cavity desired and the type of material of which the plates are made. Typically, the first and third plates 4 and 8 are die-stamped from metal such as steel, aluminum, or the like, and the second or center plate 6 is injection molded or otherwise formed of a polymeric material. Suitable polymeric materials include thermoplastic resins such as acetal homopolymer or copolymer or polycarbonate, as well as thermosetting resins such as of the phenolic type. Preferably, the buckle 2 is comprised of at least three plates, the first, second and third plates 4, 6 and 8. Each of the plates 4, 6 and 8 can be formed using conventional equipment at very low cost. As a result, the buckle 2 can be made at a lower cost than a die-cast buckle, such as the buckle described in U.S. Pat. No. 3,807,000.

The buckle 2 has means at its rear end for attaching the buckle 2 to a mounting member, such as a cable or strap, or to a safety belt (not shown). The mounting means includes an aperture 70, 72 and 74 in each of the rear ends of plates 4, 6 and 8, and in the rear end of the cover 62. The tongue 24 also has an aperture 76 for mounting the tongue to a safety belt (not shown).

In operation, the tongue 24 is inserted into the buckle 2 through the guide means 22. The lip 57 on the forward end of the second plate 6 and the converging walls 58 guide the tip 68 of the tongue 24 through the opening 60 and along a slot on the underside of the second plate 6. As the tongue moves into the buckle 2, the tip of the tongue 24 pushes against the tongue engaging portion 26 of the biasing means 14 and the opening 44 in the tongue 24 becomes aligned with the raised portion 42 of the latch bar 38. The press of the tip 68 of the tongue 24 against the upper arms 26 of the no false latch spring moves the upper arms in a first direction substantially parallel to the motion of the tongue 24 during insertion. Such movement of the upper arms 26 causes storage of energy in the coil springs 28. The springs 26 raise the lower arms 30 and the latch bar 38 when sufficient tension develops in the springs 28. As a result, the raised portion 42 of the latch bar 38 engages the tongue 24 in the buckle 2. For removal of the tongue 24 from the buckle 2, depression of the push button 50 causes movement of the lower arms 30 downwardly by the latch bar 38, which causes storage of energy in the springs 28. When the raised portion 42 of the latch bar 38 is disengaged from the opening 44 in the tongue 24, the upper arms 26 eject the tongue 24 from the buckle. Thus, the biasing means 14 only moves the latching means 10 into engagement with the tongue 24 when the tongue 24 is substantially fully inserted into the buckle 2. The biasing means 14 ejects the tongue 24 from the buckle 2 upon movement of the latching means 10 by the actuation means 12. The buckle 2 offers low resistance to insertion of the tongue 24 until the tongue 24 nears its fully inserted position in the buckle 2. Thus, the biasing means 14 solves the problem of "false latching".

What is claimed is:

1. A buckle comprising:

a plurality of plates secured together, each of said plates having a cavity in the central portion thereof, said cavities being in substantial alignment with one another; at least one of said plates including guide means extending from an exterior forward end of said plate to its cavity for guiding a tongue into the buckle;

movable latch means for engaging the tongue, a portion of said latch means extending in and movable within said cavity of at least one of said plates;

manually operable actuation means for actuating said latch means, a portion of said actuation means extending in and movable in said cavity of at least one of said plates; and a unitary biasing means disposed in said buckle near the fully inserted position of said tongue for moving said latch means into engagement with said tongue when said tongue is substantially fully inserted into said buckle and for ejecting said tongue upon movement of said latch means by said actuation means, said buckle offering low resistace to the insertion of said tongue until said tongue nears its fully inserted position in said buckle, said biasing means having a tongue engaging portion, an energy storage portion and a latch engaging portion; said tongue engaging portion, upon movement by said tongue, causing storage of energy in said energy storage portion, said energy storage portion, upon storage of a sufficient amount of energy, moving said latch means to engage said tongue in said buckle;

said tongue engaging portion comprising at least one upper arm extending through an opening in a second plate; said energy storage portion comprising at least one torsion spring attached to a third plate, said latch engaging portion comprising at least one lower arm, said lower arm extending under said latch means; said tongue, upon nearing its fully inserted position in said buckle, pushing said upper arm in a first direction substantially parallel to movement of said tongue as said tongue enters said buckle, said movement of said upper arm in said first direction developing tension in said torsion spring, said spring raising said lower arm and said latch means when sufficient tension develops in said spring.

2. The buckle of claim 1 wherein: said tongue engaging portion of said biasing means comprises two upper arms and a cross member, said cross member joined to ends of the upper arms remote from the energy storage portion, said two upper arms and said cross member forming an approximate U shape.

3. The buckle of claim 1 wherein: said energy storage portion comprises two coil springs arranged along a common longitudinal axis.

4. The buckle of claim 3 wherein: said latch engaging portion comprises two lower arms, each projecting from a remote end of one of said coil springs.

5. The buckle of claim 1 and further comprising a cover for at least substantially enclosing said plates, latch means, actuation means, and biasing means.

6. The buckle of claim 1 wherein said actuation means comprises: a push button, a biasing means for the push button, and a crush ring.

7. The buckle in accordance with claim 1 wherein said second plate is formed from a polymeric material and said first and third plates are formed of metal.

8. The buckle of claim 1 wherein said lower arm is arranged at an angle with reference to said upper arm.

* * * * *